US005634604A

United States Patent [19]

Cooper

[11] Patent Number: 5,634,604

[45] Date of Patent: Jun. 3, 1997

[54] WIRE DISPENSER WITH BASE ANTI-ROTATION LOCK

[75] Inventor: Edward L. Cooper, Clarklake, Mich.

[73] Assignee: Elco Enterprises, Inc., Clarklake, Mich.

[21] Appl. No.: 664,301

[22] Filed: Jun. 10, 1996

Related U.S. Application Data

[63] Continuation of Ser. No. 401,153, Mar. 9, 1995, abandoned.

[51] Int. Cl.[6] ..... B65H 49/00

[52] U.S. Cl. ..... 242/128

[58] Field of Search ..... 242/128; 403/350, 403/351

[56] References Cited

U.S. PATENT DOCUMENTS

| | | | |
|---|---|---|---|
| 1,834,159 | 12/1931 | King, Jr. et al. | 242/128 |
| 1,920,962 | 8/1933 | Arkema | 242/128 |
| 2,319,828 | 5/1943 | Rohweder | 242/128 |
| 2,880,305 | 3/1959 | Baird | 219/130 |
| 3,259,407 | 7/1966 | Welt | 403/350 |
| 3,618,873 | 11/1971 | Fons et al. | 242/128 |
| 3,942,826 | 3/1976 | Lester | 403/350 X |
| 3,997,127 | 12/1976 | Kovaleski | 242/128 |
| 4,206,889 | 6/1980 | Adelhardt et al. | 242/128 |
| 4,253,624 | 3/1981 | Colbert | 242/128 |
| 4,435,105 | 3/1984 | Rampley | 403/350 X |
| 4,657,204 | 4/1987 | Colbert | 242/128 |

*Primary Examiner*—John Q. Nguyen
*Attorney, Agent, or Firm*—Duncan F. Beaman

[57] ABSTRACT

Apparatus for dispensing wire from a spool, such as welding wire, wherein the spool axis is vertically oriented and the spool includes end flanges confining the wire coil. A rotatable wire dispensing arm is mounted upon a base inserted in a hole within the upper spool flange and a friction brake interposed between the base and arm controls the rate of arm rotation. An extension in the form of a cam is formed upon the base to selectively increase the friction between the base and flange hole to prevent base rotation, and the dispensing arm includes a tube internally reinforced by a coiled wear sleeve while the entrance end of the wear sleeve is provided with a hard, wear resistant ceramic ring to reduce wear.

1 Claim, 2 Drawing Sheets

WIRE DISPENSER WITH BASE ANTI-ROTATION LOCK

This is a continuation of application Ser. No. 08/401,153 filed Mar. 9, 1995, abandoned.

BACKGROUND OF THE INVENTION

1. Field of the Invention

The invention pertains to wire dispensers for dispensing and uncoiling wire from a spool having end flanges wherein the dispenser base is mounted within a coaxial hole in an end flange and the dispensed wire is guided through a rotating arm mounted upon the base.

2. Description of the Related Art

Arc welders are often supplied by welding wire from a wire coil wound upon a spool. The length of the spool is defined by spool end flanges having a central hole, and during wire dispensing, the spool axis is vertically oriented wherein the lower spool flange constitutes the spool support, and a wire dispenser is mounted upon the upper spool flange.

Welding wire dispensers often include rotating arms having wire guides or tubes supported upon a base mounted upon the spool or spool pallet and the arm may include a friction brake to control the rate of arm rotation about the spool as the wire is guided through the rotating arm. Wire dispensers of this general type are shown in U.S. Pat. Nos. 1,834,159; 2,319,828; 2,880,305; 3,618,873; 4,253,624 and 4,657,204.

In common practice, welding wire is shipped and sold on spools having wood or composite end flanges. The end flanges are provided with a hole coaxial with the spool axis which is of a circular configuration and may be three or four inches in diameter, large enough to receive the base of a rotating arm dispenser. The dispenser base is received within the upper spool flange hole, and includes coaxial bearing structure supporting the rotating arm and the rotating arm and base usually include a friction brake device for imposing a resistance to arm rotation to prevent the arm from over travel as the wire is intermittently pulled through the arm to insure a uniform dispensing of the wire through the rotating arm.

The dispenser base is held in the spool circular hole by friction and the circular base must fit snugly within the spool flange hole to prevent relative rotation between the base and the spool flange. Due to the torque imposed on the base by its friction brake, it is a common problem for the dispenser to rotate within the spool hole when the frictional engagement between the dispenser base and spool hole reduces to the point where the flange hole is no longer able to firmly and snugly support the dispenser base and inadequate support of the rotating arm occurs, and relative rotation between the base and spool flange results in improper arm rotation adversely affecting the dispensing of the wire from the spool.

Another problem which occurs with welding wire dispensers of the rotating arm type results from the wear occurring within the arm tube as many thousands of feet of wire will be pulled through the dispenser arm throughout its operating life, and the curved configuration of the arm produces high wear points such that the metal arm tube will be worn through by the movement of the welding wire therein.

OBJECTS OF THE INVENTION

It is an object of the invention to provide a wire dispenser using a rotating arm mounted upon a base inserted within a hole defined in a wire spool flange hole wherein firm frictional engagement between the dispenser base and spool flange is maintained even though the spool flange hole may be oversized.

An additional object of the invention is to provide a wire dispenser of the revolving arm type wherein the arm is mounted upon a base inserted in a wire spool flange hole wherein the base includes a radial extension in the form of a cam for increasing the circumferential dimension of the dispenser base to increase the frictional engagement between the base and the spool flange hole.

A further object of the invention is to provide a wire dispenser of the revolving arm type wherein wire is pulled through a configured tube, and where a wear sleeve is provided within the configured tube throughout its length to prevent wear upon the tube directly.

Yet another object of the invention is to provide a wire dispenser of the rotating arm type wherein the rotating arm consists of a tube having a helically coiled wear sleeve within whose lower end extends from the tube and includes a synthetic plastic nose threaded upon the wear sleeve, and a ceramic, wear resistant ring is mounted in the nose to minimize wear as the dispensed wire enters the wear sleeve and revolving arm.

SUMMARY OF THE INVENTION

Welding wire with which the invention is employed is wound upon a spool having a hub and end flanges. The spools are normally formed of wood, but can be made of a rigid composite material. The spool end flanges each include a circular hole coaxial with the spool axis, and the wire dispenser in accord with the invention includes a base which is inserted into the spool flange hole.

The wire dispenser utilizing the inventive concepts includes a circular base having a circular cylindrical skirt portion insertable into the flange hole. The exterior surface of the skirt portion is preferably roughened or knurled to increase the frictional engagement between the base surface and the flange hole. The base includes an upwardly extending tubular column containing bearing structure for rotatably supporting the arm support which is coaxially aligned with the spool and base axis.

The arm support carries a curved arm tube having an upper end coaxial with the arm support through which the dispensed wire is pulled, and the revolving arm tube lower end extends toward and around the circumference of the upper spool flange circumference, and the arm tube includes a wear sleeve which extends adjacent the spooled wire.

The dispenser base is held in the spool hole, and if the spool hole has a diametrical dimension larger than specified, the hole will not provide a firm supporting of the dispenser base, and may permit the base to rotate within the spool flange hole, which produces an unacceptable support for the dispenser. To prevent a "loose" relationship between the dispenser base and the spool flange hole, an extension is mounted upon the base which is capable of being radially extended into engagement with the spool flange hole to force the portions of the base diametrically oppositely located with respect to the extension into firm engagement with the spool flange hole and achieve a firm frictional supporting relationship between the spool flange and the dispenser base.

Preferably, the base extension is in the form of a cam eccentrically mounted on the base upon an axis substantially parallel to the axis of the spool and rotation of the arm, and the cam wedges itself against the spool hole upon adjustment. Preferably, the cam is located such that reaction rotative forces imposed upon the base due to the rotation of the arm are in such a direction as to tighten the engagement of the cam against the flange hole so that the firm engagement between the base and the flange hole is maintained during wire dispensing and will actually tighten and increase the frictional engagement between the base and spool flange during use.

Due to the sinuous curved configuration of the rotating arm tube, the movement of welding wire therethrough will engage specific portions of the tube and wear through the tube unless protection is provided, and in accord with the inventive concepts, a wear sleeve of contiguously helically coiled wire is located within the arm tube throughout its length to protect the tube from direct contact with the welding wire pulled therethrough.

The lower end of the helically wound wear sleeve extends from the lower end of the tube arm, and at its outer free end includes a tubular synthetic plastic nose which is threaded upon the coils of the wear sleeve. The nose also includes an annular ceramic wear ring coaxial with the nose axis through which the wire is pulled, and the ceramic ring prevents extensive wear upon the nose and the lower region of the wear sleeve. As the greatest degree of wear occurs between the wire and the dispenser at the ceramic ring and wear sleeve, a dispenser constructed in accord with the inventive concepts has an unusually long wear life before maintenance and replacement is required.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
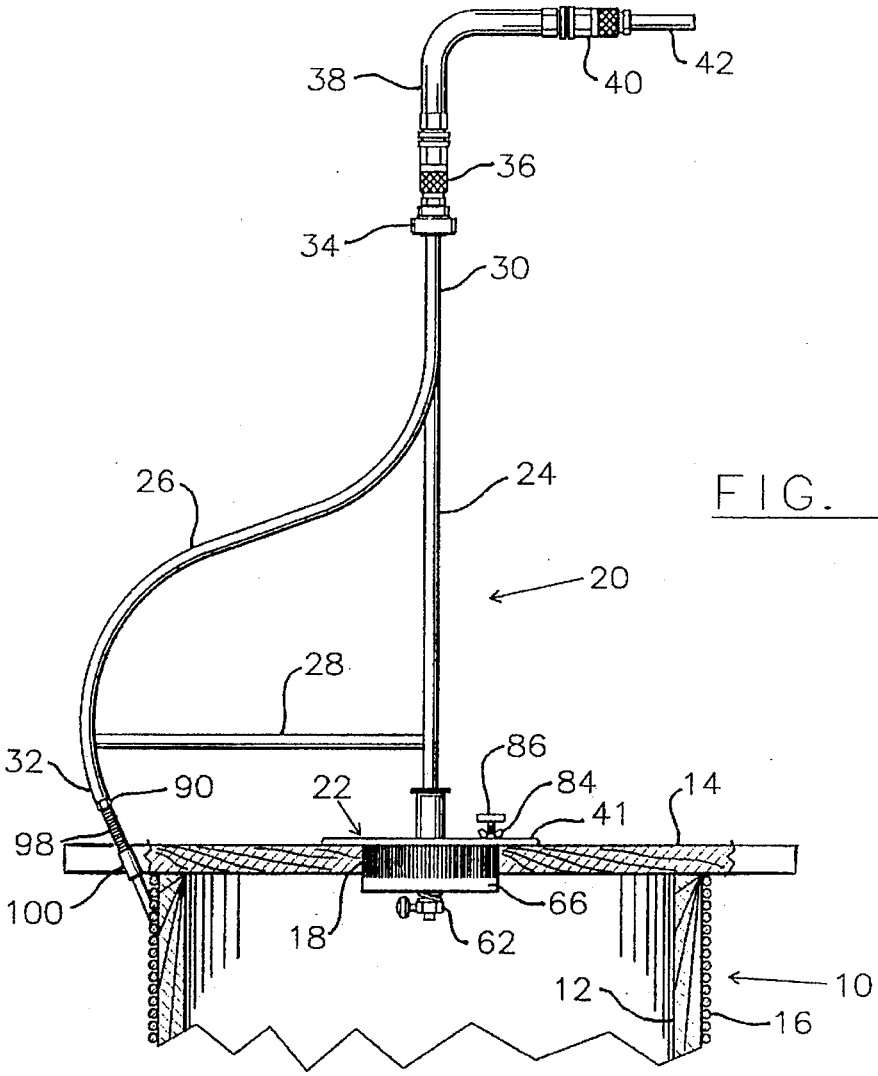
FIG. 1 is an elevational partially sectioned view of a wire dispenser utilizing the inventive concepts as mounted on a spool.

As will be apparent in FIG. 1, wherein a welding wire dispenser in accord with the invention is mounted upon a wire spool, the spool is generally indicated at 10. The spool 10 may be formed of wood, or a composition material, and includes a hub 12 which is defined at each end by a spool end flange 14, only the upper flange 14 being visible in FIG. 1. The welding wire 16 is wound upon the hub 12, and during dispensing the axis of the spool 12 is vertically oriented wherein the spool sits upon the lower flange 14, not shown.

A circular flange hole 18 is defined in the upper flange 14 coaxial with the hub end circular flange, and as will be later appreciated, the diameter of the flange hole 18 is sufficient to receive and support the wire dispenser.

The wire dispenser is generally indicated at 20 and is mounted upon the upper spool end flange 14. The dispenser 20 includes a base 22 received within the spool end flange hole 18, and the base 22 rotatably supports a vertically extending arm column 24 which is coaxial with the spool and flange axis. A shaped curved arm 26 formed of a tube is mounted upon the column 24 and a brace 28 interposed between the arm and arm column helps support the arm upon column 24. The upper end 30 of the arm 26 merges into the upper portion of the arm column 24 as to be coaxial therewith, and the arm lower end 32, as supported by brace 28, is located radially beyond the circumference of the spool end flange 14 for receiving the dispensed wire, as later explained.

An anti-friction bearing 34 is mounted upon the arm upper end 30 coaxial with the column 24, and a quick acting coupling 36 is associated with the bearing 34 wherein the tubular elbow 38 may be quickly connected to the arm upper end 30 by coupling 36. The other end of the elbow 38 supports another quick acting coupling 40 which connects a wire supply tube 42 to the dispensing apparatus, and the supply tube 42 transfers the dispensed wire to the point of wire use, i.e. welding equipment, not shown. The couplings 36 and 40 may be of the type shown in U.S. Pat. No. 4,657,204.

The base 22 includes a flat base plate 41 which engages the upper surface of the spool end flange 14 when the dispenser is fully mounted upon the end flange within hole 18. The base plate 41 includes a tubular column support 44, FIG. 2, having a sleeve bearing 46 located therein. An annular stop washer 48 affixed to the arm column 24 engages the bearing 46 and supports the column.

The lower portion of the arm column 24 constitutes a solid arm column extension 50 which is threaded at its lower end and includes diametrically opposed flats 54. The extension 50 extends through a brake disc 56 having a complimentarily shaped hole therein for receiving the extension 50 and flats 54 wherein the flats 54 establish a torque transmitting relationship between the extension 50 and the metal brake disc 56. An annular fiber friction disc 58 is located between the metal brake disc 56 and the underside of the base plate 41, as will be appreciated from FIG. 2. A compression spring 60 engages the underside of the brake disc 56 and the spring bears against a nut 62 located upon the lower threaded end of the extension 50. A lock screw 64 formed in the nut 62 prevents rotation of the nut once the desired adjustment is made.

The spring 60 imposes an upward biasing force upon the brake disc 56 which is capable of axial displacement on the arm column extension 50. Accordingly, the spring 60 will frictionally compress the fiber disc 58 between the brake disc 56 and the base plate 41 producing the desired friction "drag" or braking of the rotation of the arm 26 during wire dispensing to prevent excessive rotation of the arm and provide optimum unwinding of the wire 16 from the spool 10. Positioning of the nut 62 to increase the compression of the spring 60 increases the friction imposed on the rotation of the arm 26, while reducing the compression of spring 60 decreases the friction braking action achieved.

Figure 2:
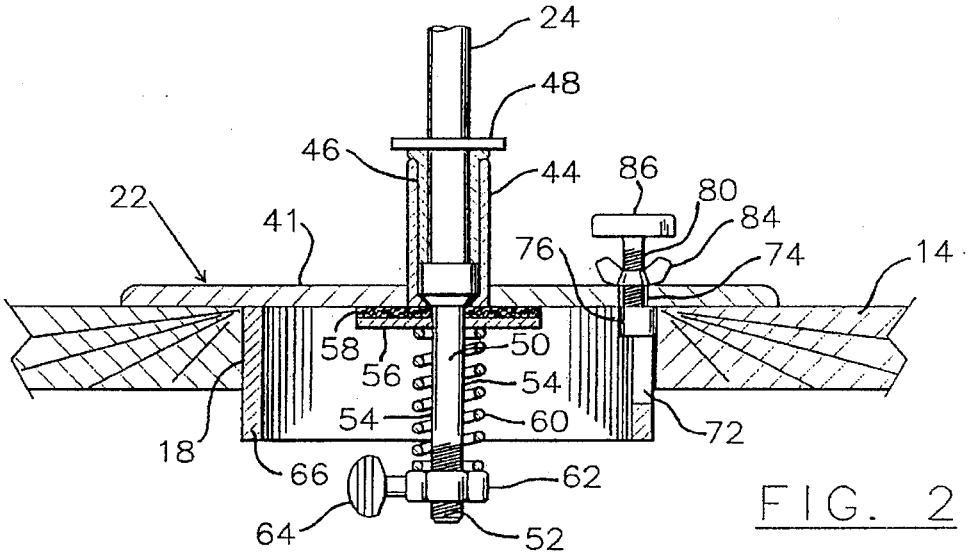
FIG. 2 is an enlarged elevational sectional view of the wire dispenser base components.

An annular base skirt or extension 66 concentric with the base plate 41 is mounted upon the lower surface of the base plate 41 and is received within the spool end flange hole 18, as will be appreciated from FIG. 2. The skirt extension 66 includes an outer cylindrical surface 68 closely received within the flange hole 18, and to increase the frictional engagement between the skirt extension 66 and the flange hole 18, a knurling 70, FIG. 3, is located upon the skirt extension surface 68 which directly engages the end flange spool hole.

Because of the effect of the friction braking action produced by the brake disc 56 and fiber disc 58, a torque is imposed upon the dispenser base 22 endeavoring to rotate the base within the spool end flange hole 18. While the knurls 70 resist this torque to minimize rotation of the dispenser base within the end flange hole, the diameter of hole 18 may be slightly oversize and rotation of the base may occur and friction enhancing structure is mounted upon the base 22 to "lock" the base 22 within the spool end flange hole 18.

Figure 3:
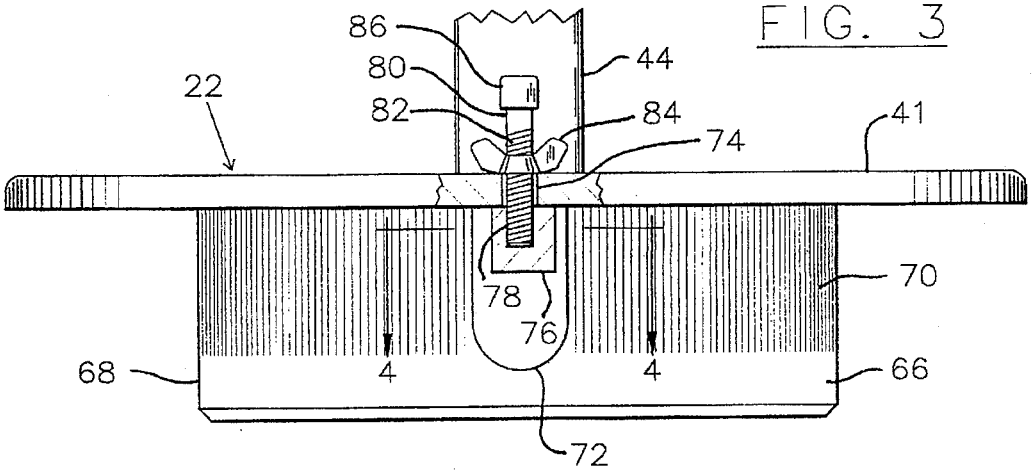
FIG. 3 is an elevational view, partially sectioned, of the wire dispenser base.

To this end, a recess 72 is defined within the base cylindrical skirt extension 66, FIGS. 2 and 3, the recess being located adjacent the base plate 41, and the base plate is provided with a bore 74 intersecting the recess. A cam 76 is located within the recess 72 adjacent the base plate 41 and the cam 76, which is of a generally cylindrical configuration, includes a blind threaded bore 78 which is eccentrically related to the surface of the cam 76 as will be appreciated from FIG. 3. A pivot shaft or camshaft 80, which is threaded into the cam threaded bore 78 upon threads 82 is firmly threaded into the cam 76 such that relative rotation therebetween does not occur. The camshaft 80 is rotatably mounted in bore 74 and wing nut 84 is threaded upon the camshaft threads 82 located above the base plate 41. The upper end of the camshaft 80 is provided with a T handle 86 which permits the camshaft 80 to be rotated as desired. The axis of rotation of the pivot shaft or camshaft 80 is parallel to the axis of base 22 and the axis of rotation of the arm 26.

Figure 4:
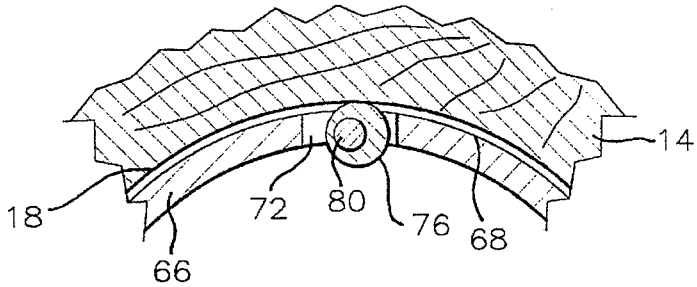
FIG. 4 is a plan sectional elevational view as if taken along Section 4—4 of FIG. 3 illustrating the relationship of the cam to the spool hole.

Because the camshaft 80 is eccentrically related to the surface of the cam 76, as will be appreciated from FIG. 4, and because the cam 76 is located within the recess 72 so that the surface of the cam will extend beyond the circumference of the base skirt extension surface 68, rotation of the camshaft 80 by the handle 86, when the wing nut 84 is unloosened, will rotate the cam 76 causing the cam to extend beyond the circumference of the surface 68 to firmly engage the spool end flange hole 18, FIG. 4. Such rotation of the cam 76 to engage the flange hole 18 increases the circumference of the surface 68, and forces the diametrically opposite side of the skirt extension 66 into firm engagement with the flange hole 18 wherein the knurls 70 may firmly frictionally engage the flange hole 18. Accordingly, it will be appreciated that rotation of the camshaft 80 significantly increases the frictional engagement between the dispenser base 22 and the flange hole 18 and prevents rotation of the base 22 relative to the flange 14. Once the desired angular adjustment of the camshaft 80, and positioning of the cam 76, is made, the wing nut 84 may be tightened to bear against the base plate 14 and prevent rotation of the cam and cam shaft, and maintain the desired cam setting.

Preferably, the direction of rotation of the camshaft 80 during positioning of the cam 76 is in a direction opposite to the normal direction of rotation of the arm 26 during the dispensing of wire. Accordingly, the reaction forces imposed upon the base 22 due to the frictional braking of the arm 26 will tend to rotate the base 22 in a direction tending to rotate the cam 76 in a direction which increases the frictional engagement between the cam and the flange hole 18, i.e. the tendency of the cam 76 to rotate due to base rotation will cause the cam to push into the flange hole surface. Accordingly, the cam 76 will be self tightening, and in the event that the wing nut adjustment 84 inadvertently loosens, the cam 76 will continue to maintain a firm frictional engagement with the flange hole which actually increases if rotation of the base 22 within the flange hole 18 occurs.

Figure 5:
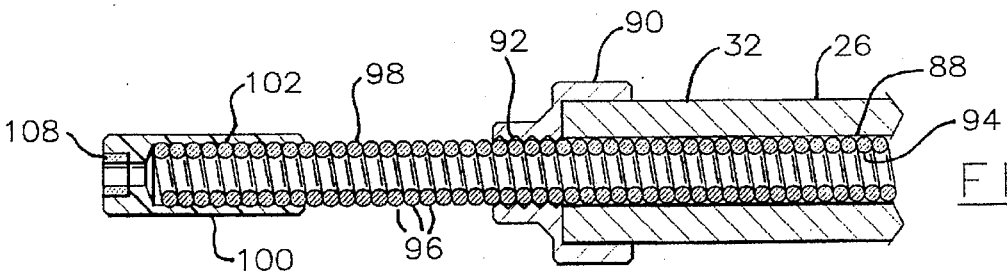
FIG. 5 is an enlarged detail elevational diametrical sectional view of the lower end of the tube, wear sleeve and nose.
Figure 6:
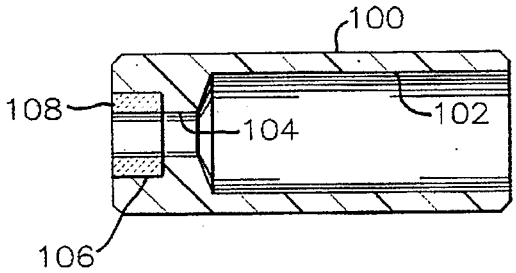
FIG. 6 is an enlarged elevational diametrical sectional view of the wire sleeve nose, per se.

The arm 26 comprises an arcuately configured curved tube as will be appreciated from FIG. 10, and the arm tube inner surface is represented at 88 in FIG. 5, and an annular adapter 90 is attached to the arm lower end 32 by soldering, brazing, or the like. The adapter 90 includes a smaller diameter threaded bore 92 as will be appreciated in FIG. 5.

To prevent the arm inner surface 88 from directly engaging the wire 16 being pulled through the arm 26 during dispensing, a wear sleeve 94 is located within the arm 26 through its full length. The wear sleeve 94 extends from the lower end of the arm 26 to the bearing 34 to protect the arm 26 throughout its entire length. The wear sleeve 94 is, preferably, formed of a metallic wire helically wound configuration having a plurality of contiguous coils 96. The wear sleeve 94 does not constitute a spring, but is capable of lateral flexing to conform to the configuration of the arm 26 when it is initially inserted therein. Of course, the inner diameter of the wear sleeve 94 is greater than the diameter of the welding wire 16 passing therethrough.

The lower end 98 of the wear sleeve 94 extends through the adapter bore 92 whose threads will engage the coils. The wear sleeve lower end 98 extends beyond the end of the arm 26, as will be appreciated from FIG. 1, and the free outer end of the wear sleeve 94 is provided with a nose 100 of an annular configuration and formed of a synthetic plastic material such as sold under the trademark Delrin.

The nose 100 includes a large coaxial bore 102 and a small bore 104 intersects bore 102 and is provided with a countersunk bore 106 which receives the annular ceramic wear ring 108 which is mounted in the countersunk bore 106 by a press fit. The normal diameter of the nose bore 102 is slightly less than the outer diameter of the wear sleeve 94, and, accordingly, the nose 12 may be "screwed" upon the outer end of the wear sleeve 94 so that the wear sleeve will be mounted within the nose 100 as shown in FIG. 5. Wire 16 entering the nose 100, and the wear sleeve 94, passes through the ceramic ring 108 and in view of the very hard high wear resistant characteristics of the ceramic ring 108, the nose 100 need only infrequently be replaced. Likewise, the presence of the wear sleeve 94 prevents the arm 26 from being directly engaged by the welding wire 16 passing therethrough, and no direct wear on the arm 26 occurs. If necessary, the wear sleeve 94 may be easily replaced by pulling it from the arm tube.

In use, the dispenser 20 is mounted within the flange hole 18 in the described manner, and the wing nut 84 is unloosened so that the camshaft 80 may be rotated by the T handle 86 to firmly engage the cam 76 with the spool flange hole 18. In this manner, the desired frictional engagement between the base 22 and the spool 10 is achieved and the wing nut 84 is tightened. The brake nut 62 is adjusted on the column extension 50 to produce the desired frictional braking force, and as the welding wire 16 is pulled through the dispensing apparatus through the tube 42 by the wire feeder associated with the welder, not shown, the arm 26 will revolve about the wire 16 wound on spool hub 12 and smoothly feed the wire through the ring 108 and into the wear sleeve 94, through coupling 36, elbow 38 and coupling 40 through the supply tube 42. The feeding of welding wire is erratic with many stops and starts, and the braking action produced by the discs 56 and 58 will prevent excessive rotation of the arm 26, and the cam 76 will prevent rotation of the dispenser base 22 relative to the spool 10.

It is appreciated that various modifications to the inventive concepts may be apparent to those skilled in the art without departing from the spirit and scope of the invention.

I claim:

1. A wire dispenser for dispensing wire wound upon a spool in a first direction, the spool having an end flange having a central circular spool end flange hole, the dispenser including a circular base having a radius adapted to be inserted into the end flange hole, a rotatable wire guide and pick-off arm rotatably mounted on the base having an axis of rotation and rotated in a second direction opposite to the first direction by the movement of the unwinding wire therethrough, a friction brake mounted on the base frictionally resisting arm rotation imposing a torque on the base in the second direction, the base having a circular circumference of given dimension adapted to be located within the end flange hole frictionally engaging the end flange hole, the improvement comprising, a pivot mounted on the base including a shaft having an axis substantially parallel to the wire guide and pick-off arm axis, an opening defined in the base circumference, an anti-rotation base extension mounted on said base mounted pivot and radially extending from the base circumference through said opening comprising a cam having an exterior cylindrical surface mounted on said pivot shaft eccentric to said pivot shaft axis, said cam surface radially extending from the base circumference and engageable with the spool end flange hole for increasing the friction between the flange hole and base circumference, said engaged cam surface being radially outward and ahead of said pivot shaft axis with respect to the arm rotation in the second direction to cause the cam surface to radially move further outwardly to increase the frictional engagement between said cam surface and the flange hole upon the tendency of rotation occurring of the base within the flange hole in the second direction due to the torque imposed on the base during arm rotation, and a handle mounted on said pivot shaft to permit manual rotation of said shaft.

* * * * *